United States Patent [19]

Shinohara

[11] 4,363,187

[45] Dec. 14, 1982

[54] TOY CAPABLE OF REPEATEDLY UPSETTING AND THEN RIGHTING ITSELF

[75] Inventor: Masao Shinohara, Tokyo, Japan

[73] Assignee: Tomy Kogyo Co., Inc., Tokyo, Japan

[21] Appl. No.: 304,617

[22] Filed: Sep. 22, 1981

Related U.S. Application Data

[63] Continuation of Ser. No. 52,631, Jun. 28, 1979, abandoned.

[30] Foreign Application Priority Data

Jul. 1, 1978 [JP] Japan ..... 53-91565

[51] Int. Cl.[3] ..... A63H 17/26

[52] U.S. Cl. ..... 46/211

[58] Field of Search ..... 46/211, 212, 213, 201, 46/206, 202, 103, 104, 106, 107

[56] References Cited

U.S. PATENT DOCUMENTS

| | | | |
|---|---|---|---|
| 1,614,227 | 1/1927 | Birrell | 46/201 |
| 1,651,292 | 11/1927 | Ramage | 46/211 X |
| 1,846,823 | 2/1932 | Westberg | 46/211 |
| 1,875,109 | 8/1932 | Muller | 46/211 X |
| 2,247,354 | 7/1941 | Berger | 46/206 X |
| 3,000,137 | 9/1961 | Vine | 46/211 X |
| 3,574,267 | 4/1971 | Schorsch | 46/211 |
| 4,300,308 | 11/1981 | Ikeda | 46/212 X |

*Primary Examiner*—Mickey Yu

*Attorney, Agent, or Firm*—K. H. Boswell; Edward D. O'Brian

[57] ABSTRACT

A mechanical toy capable of turning itself upside down has a body shell shaped to include a curved surface such that when it is self inverted it rolls upon the curved surface back to its upright position. The body includes supporting members, preferably wheels, on which the body normally will rest. An inverting member is operatively attached to a motor and cyclically raises one end of the body allowing the body to pivot about a pivot surface which imparts a rolling motion to the body. The body rolls from the pivoting surface about its curved surface to its upright position and then preferably rolls on its wheels until it once again inverts itself.

9 Claims, 10 Drawing Figures

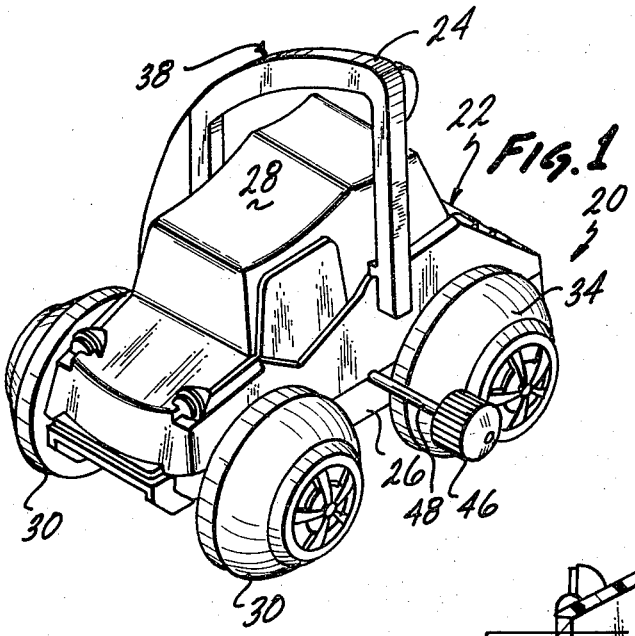
FIG. 1
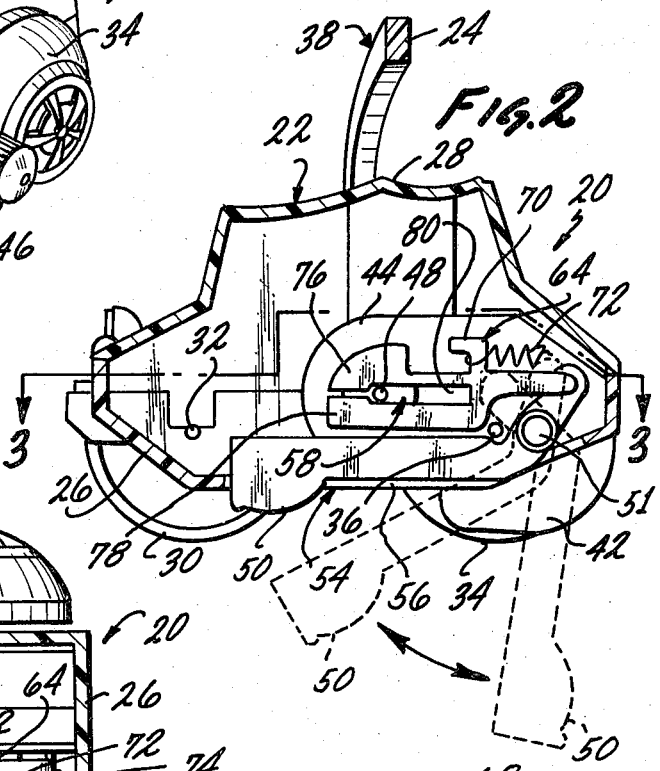
FIG. 2
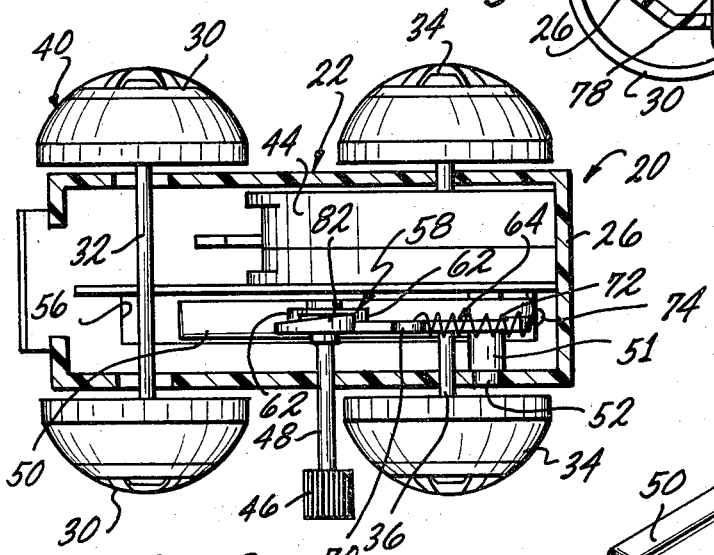
FIG. 3
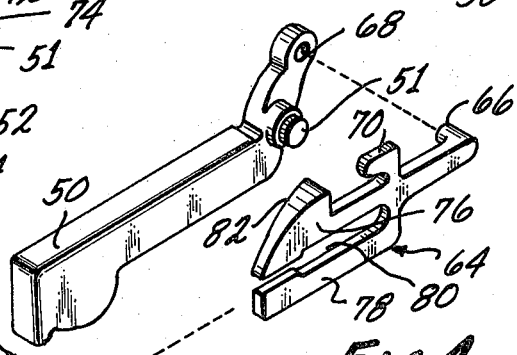
FIG. 4
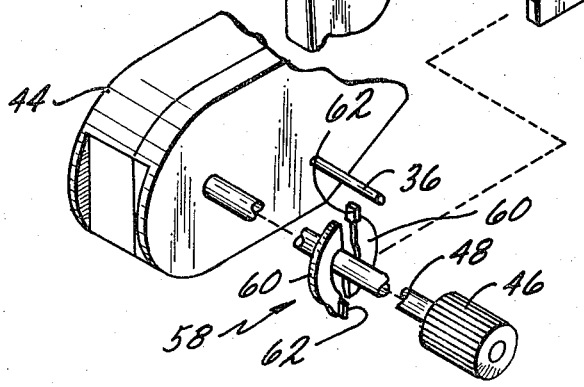

TOY CAPABLE OF REPEATEDLY UPSETTING AND THEN RIGHTING ITSELF

This application is a continuation, of application Ser. No. 052,631, filed June 28, 1979, now abandoned.

BACKGROUND OF THE INVENTION

This invention relates to a toy which repeatedly turns itself upside down and then rolls upon a curved surface incorporated in the toy from its uprighted position back to its upright position.

Toys are known which have a rounded outside surface and are weighted or otherwise constructed such that their center of gravity is located below the center of rotation of the rounded surface. If this type of toy is placed upside down it will, because the center of gravity is lower than the radius of curvature, roll about its curved surface until it comes to rest in an upright position wherein the center of gravity is again located below the radius of curvature. These toys, however, do not have the ability to invert themselves but must be physically inverted by the user of the toy.

A second type of toy is known which has the ability to upset itself. This type of toy uses a mechanism wherein the toy is steered by two wheels whose axle is pivotally mounted to the toy via pivots which are displaced about a wheel's radius to the rear of the axle. Depending upon the exact distance of this rearward displacement of the pivots and a particular velocity of the vehicle it is possible for this vehicle to spontaneously have its front steering wheels fully displaced either to the left or right causing the vehicle to upset itself about its front wheels. While this mechanism is very interesting and of considerable play value, because of the necessary tuning of the vehicle velocity with steering component dimensions, the vehicle may not always upset itself. Once the before described vehicle has upset itself it has the ability to right itself through a combination of a projection projecting downward from the body and an oversized winding key attached to its spring motor. The winding key lifts the side of the vehicle up until it is once again resting on its wheels.

A different type of toy vehicle has the ability to do "wheelies". This toy vehicle has a fifth wheel which is mounted on a lever. The lever is pivotally mounted to the vehicle near the vehicles front wheels and then extends toward the rear of the vehicle placing the fifth wheel somewhere toward the center of the vehicle. When the lever is activated or rotated about its fulcrum the fifth wheel descends downward causing the front end of the vehicle to be raised. This type of mechanism, however, is not useful to completely upset a vehicle because of the location of the fulcrum point of the lever. Because the lever is pivoted to the front of the vehicle, but the vehicle itself pivots about the rear wheels, it is never possible to lift the front end of the vehicle a sufficient height to cause the vehicle to rotate about its axles and flip over.

In U.S. Pat. No. 3,728,815, assigned to the same assignee as this patent, there is described a toy which travels on a horizontal surface. The arms of this toy rotate about attachment points and if the toy is confronted with a vertical surface the rotating arms contact the vertical surface, upset the toy and then further flip the toy about its head until it is again uprighted.

From the above descriptions of known toys it is evident that there is considerable play value in constructing a toy which combines an upsetting or righting movement in combination with the normal rolling movement of the toy. None of the toys described, however, have the ability to repeatedly upset themselves while traveling on strictly a horizontal surface, and while traveling at a variable velocity, i.e. whatever momentary velocity their fully or partially wound spring motors may propel them at as the spring tension is released.

BRIEF SUMMARY OF THE INVENTION

In view of the above it is an object of this invention to provide a toy which is capable of traveling on a horizontal surface, capable of upsetting itself, rolling about itself and then depositing itself in its upright position and continue traveling on the horizontal surface.

It is a further object to provide a toy which, because it can be easily and simply constructed, can be mass produced and therefore sold at a reasonable cost. Additionally, it is an object to provide a toy which is easy to operate and thus enjoyable for a small child but yet is sophisticated in its operation and thus provides an interesting toy for a wide variety of age levels.

These objects and other objects which will become evident from the remainder of this specification are satisfied by providing a toy capable of moving from an upright position to at least a semi-inverted position and back again to the upright position. The toy includes a body shaped so as to have a lower surface, a pivot surface and a curved surface. The body is supported above a supporting horizontal surface by one or more support members. The toy includes a pivoting member mounted to the body which is capable of pivoting in respect to the body from a retracted position in the lower surface toward a supporting surface. Mounted within the body is a spring wound motor. The rotary motion of the motor is transferred to the pivoting member via an activating member. When the activating member transfers motion to the pivoting member the pivoting member pivots down until it makes the above noted contact with the supporting surface. Since further movement of the pivoting member is now inhibited by the supporting surface, motion of the pivoting member is transferred to the body of the toy causing it to lift up on one end tilting it in respect to the supporting surface. This places the pivot surface of the body in contact with the supporting surface. Further motion of the pivoting member in respect to the body of the toy rolls the toy about the pivot surface until the toy is given sufficient momentum to cause it to roll about the pivot surface and continue rolling about the curved surface. The toy rolls completely about the curved surface and comes to rest in an upright position where once again the body is supported by the supporting members. During rolling of the toy the pivoting member is retracted back to its original position ready to once again upset or flip the toy over.

Preferably the supporting members are wheels which are also connected to the motor and propel the toy along the horizontal supporting surface. The toy will travel along the surface and be flipped over by the pivoting member causing it to roll about its curved surface and as soon as it returns to its upright position it once again will be propelled by its wheels on the supporting surface.

Preferably the body is constructed to mimic a vehicle such as an airplane or small car and additionally to this likeness to a vehicle the body can be somewhat characterized by providing it with a somewhat animated appearance. The curved surface of the body can be such that the toy will roll about its transverse axis or alternately the curved surface can be along the transverse axis such that the toy will roll about its longitudinal axis. Additionally the curved surface could be a combination of the above two curved surfaces causing the toy to roll in a compound motion.

BRIEF DESCRIPTION OF THE DRAWINGS

This invention will be better understood when taken in conjunction with the drawings wherein:

FIG. 1 is an isometric view of one embodiment of the invention;

FIG. 2 is a side elevational view in partial section of the embodiment shown in FIG. 1 and showing one element of the invention in both solid and phantom lines;

FIG. 3 is a plan view in partial section about the line 3—3 of FIG. 2;

FIG. 4 is an exploded view partially cut away of certain of the working components found within the interior of the invention;

Figure 5:
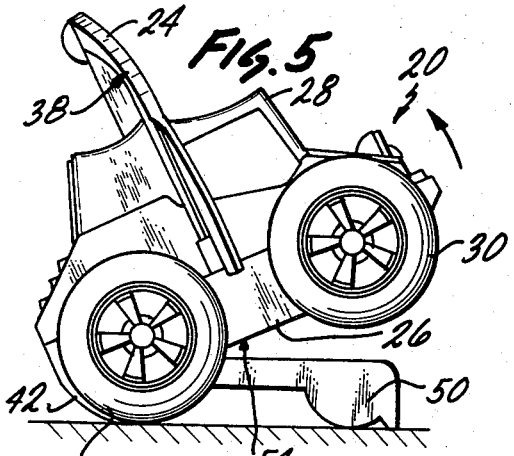
FIGS. 5, 6 and 7 illustrate the embodiment shown in FIG. 1 as it performs a sequence of mechanical actions.

The toy illustrated in this specification utilizes certain principles and concepts as are set forth and defined in the amended claims forming a part of this specification. It is to be realized that those experienced in the toy design arts could utilize these principles or concepts in a number of differently appearing embodiments without departing from the spirit or scope of this invention. For this reason this invention is to be construed in light of the appended claims and should not be construed as being limited solely to the embodiments illustrated in the specification and the drawings.

DETAILED DESCRIPTION

The toy 20 has an outside housing 22 which serves several purposes. The housing 22 serves as a support means for certain internal components as hereinafter described in addition to providing a curved surface on which the toy 20 can roll. For the embodiment illustrated in FIGS. 1 through 7 the housing 22 is in the shape of a dune buggy-type vehicle. A curved member 24 in the shape of a roll bar is formed as part of the housing 22. For ease in construction of the toy in the embodiment illustrated in FIG. 1 the housing would be constructed of three pieces including a bottom section 26, a top section 28 and the curved member 24.

Figure 7:
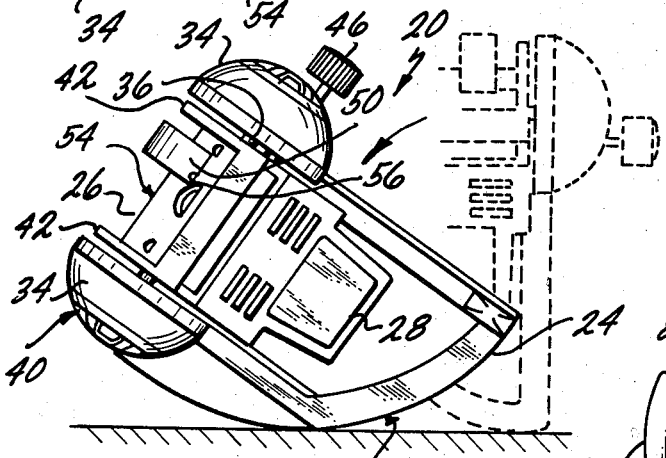

The housing 22 is rollably supported by two front wheels collectively identified by the numeral 30 attaching to an axle 32 passing through the bottom section 26 and two rear wheels collectively identified by the numeral 34 attaching to an axle 36. The axle 36, as hereinafter described, is operatively connected to a motor (identified later) which turns axle 36 and thus rear wheels 34 propelling the toy 20 along a horizontal surface. The wheels 30 and 34 for the embodiment illustrated in FIG. 1 are semi-spherical in shape. As is best seen in FIG. 7 the arc or curve generated by the top surface 38 of curved member 24 is continued by the outside curved surface 40 of the wheels 30 and 34.

Projecting down from and placed one on either side of bottom section 26 near the rear wheels 34 are two projections forming two pivot surfaces collectively identified by the numeral 42. These pivot surfaces 42 are best seen in FIGS. 2 and 7. When the toy 20 is evenly supported by both the front wheels 30 and the rear wheels 34 the pivot surfaces 42 are held slightly above the surface on which the toy rests and are not in actual contact with this surface. The pivot surfaces 42, do however, project rearward from the rear wheels 34 and if the toy 20 is pivoted about rear wheels 34 such that the front wheels 30 are lifted, the pivot surfaces 42 contact the surface on which the toy 20 rests and as the toy is further pivoted about the pivot surfaces 42 the rear wheels 34 are lifted also.

A spring motor 44 is mounted within the interior of housing 22. This motor 44 could be anyone of a number of different constructions and therefore for the purpose of this specification the mechanical details of the motor 44 are not shown. It being deemed sufficient simply to note that the spring within the motor 44 is energized by turning knurled knob 46 which is mounted on the end of shaft 48. The remainder of the spring motor 44 has a plurality of other components which are commonly known in the toy art. The shaft 48 projects out from one side of the housing 22 making the knurled knob 46 accessible to the user of the toy so that the user of the toy can wind the motor 44 to energize the toy.

For the embodiment illustrated in FIGS. 1 through 7 it is important, however, that the shaft 48 and the knurled knob 46 be located on the opposite side of the toy from the curved member 24. In this manner of construction the shaft 48 and the knob 46 do not interfer with the rolling of the toy about the curved top surface 38 of curved member 24 and the curved surface 40. The rear axle 36 passes through the motor 44 and is in fact coupled to the motor mechanism such that the axle 36 is rotated by the motor 44 allowing the toy 20 to be propelled by the rear wheels 34.

A pivoting member 50 which generally can be considered as a bell crank having arms of unequal length is mounted within the bottom section 26. The mounting is accomplished via shaft 51 integrally formed with the member 50 which fits into bearing surfaces collectively identified by the numeral 52 in the bottom section 26. This allows the pivoting member 50 to pivot downward from the bottom surface 54 of the bottom section 26 of housing 22. This pivoting motion is best illustrated in FIG. 2 wherein the pivot member 50 is shown in solid lines in one position and in phantom lines in a position showing it extending away from the bottom surface 54. The bottom surface 54 contains a cutout 56 allowing the pivot member 50 to be drawn up within the bottom section 26 out of the way so that the toy 20 can completely be supported by the front and rear wheels 30 and 34. This allows the toy to be propelled at least part of the time as hereinafter explained along a horizontal surface.

As spring motor 44 unwinds, shaft 48 is caused to turn. As illustrated in FIG. 4 this turning or unwinding motion would be in a counterclockwise direction. Fixedly attached to the shaft 48 such that it rotates with the shaft 48 is a circular member 58 which is split such that it has two arms each identified by the numeral 60. Located on the end of each of the arms 60 are identical ratchet teeth 62. The circular ring member 58 is constructed preferably of a metal or plastic material which allows the arms 60 to flex in a direction along the axis of shaft 48.

A linking member 64 has a journal pin 66 on one end thereof which fits into bearing 68 on the short arm of pivoting member 50. The other end of linking member 64 is trifurcated. The shorter of the furcations 70 serves as a point on which spring 72 attaches. The other end of spring 72 is attached to a small projection 74 extending upward from bottom section 26. The two longer furcations form fingers 76 and 78 having a small channel 80 in between them. The fingers 76 and 78 fit over shaft 48 in between circular ring member 58 and knurled knob 46. The channel 80 allows the linking member 64 to slide along shaft 48. The upper surface of finger 76 is formed as a wedge 82 as can be best seen in FIG. 4.

The wedge 82 is in a position to interact with the ratchet teeth 62 on circular member 58. As circular member 58 turns one of the two ratchet teeth 62 will engage against the wedge 82 and upon further turning of circular member 58 the interaction of wedge 82 with teeth 52 pulls linking member 64 against the bias of spring 72. As linking member 64 slides along shaft 48 this motion in turn is transferred to pivot member 50 causing pivot member 50 to descend downward from bottom section 26 as is seen in FIG. 2. After circular ring member 58 has turned about ninety degrees tooth 62 slips free of wedge 82 and linking member 64 slides toward the rear of toy 20. This in turn is transferred to pivot member 50 retracting pivot member 50 back into the cutout area 56 on bottom surface 54. A further quarter turn of shaft 48 brings the other tooth 62 in contact with wedge 82 and repeats the sliding motion of linking member 64 along shaft 48 and the accompanying motion of pivot member 42. Thus for every turn of shaft 58 the pivot member 42 is extended from and retracted back into cutout area 56 twice.

When knurled knob 46 and shaft 48 are turned in the other direction to wind the spring motor 44 the ratchet teeth 62 can slide by fingers 76 of linking member 64 because the arms 60 to which the teeth 62 are attached are displaced inwardly toward motor 44. The arms 60 thus act as small clutchs allowing the ratchet teeth 62 to be engaged against the linking member 64 in one direction of rotation, but slipping along the surface in the other direction of rotation.

Figure 6:
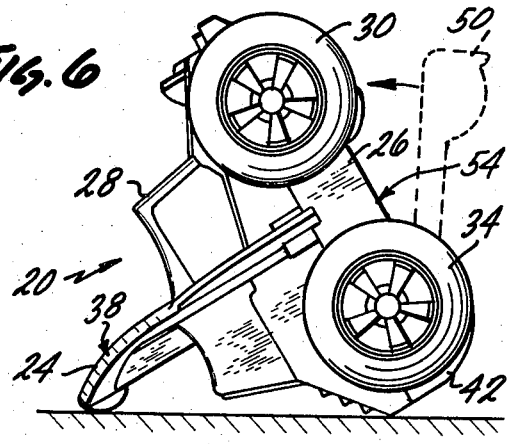

Referring now to FIGS. 5, 6 and 7 the embodiment of the toy illustrated in these figures is seen doing a flip upon itself and then rolling about the curved member 24. The toy 20 as previously explained travels along a surface on its wheels 30 and 34. The axle 36 and the shaft 48 are appropriately rotated by the motor 44 such that the axle 36 turns at a greater rotational speed than the shaft 48. This allows the toy 20 to be propelled along the surface at a fairly decent velocity and provides for a slower velocity of shaft 48 but a greater amount of torque enabling it to effectively cause pivot member 50 to rotate with a sufficient force to lift the weight of the toy 20. When one of the teeth 62 engages against the wedge 82 the pivot member 50 is pivoted in a downward direction until it strikes the surface on which the toy 20 rests. At this point because the surface has a much greater mass than the toy 20, further movement of the pivot member 50 is transferred to the toy 20. This causes the toy 20 to tilt raising that portion distal to where the pivot member 50 is hinged to the bottom section 26 of the bottom surface 54 upwardly and lowering pivot surface 42 until it comes in contact with the supporting surface.

The toy 20 then further rolls or pivots upon bearing surface 42 until curved member 24 comes in contact with the supporting surface. Meanwhile, pivot member 50 has been fully extended and is now being retracted toward the bottom surface 54 as previously explained. When the toy 20 is resting in what can best be described as a semi-inverted position it starts to roll along the curved member 24 as is best seen in FIG. 7. As is evident from FIG. 7 the curved surfaces 40 of the wheels serve as an extension of the curved member 24, that is to say, the curved surface 40 included as a part the wheels allows the toy 20 to first roll about the curved member and then further roll about the curved wheels and then come to rest in an upright position wherein it is again fully supported on the supporting surface by all of the wheels 30 and 34. As soon as the toy 20 is in its upright position it is immediately propelled forward by the rotation of the rear wheels 34 and as soon as a second of the ratchet teeth 62 engages linking member 64 the rolling motion of the toy 20 will again be repeated.

Figure 8:
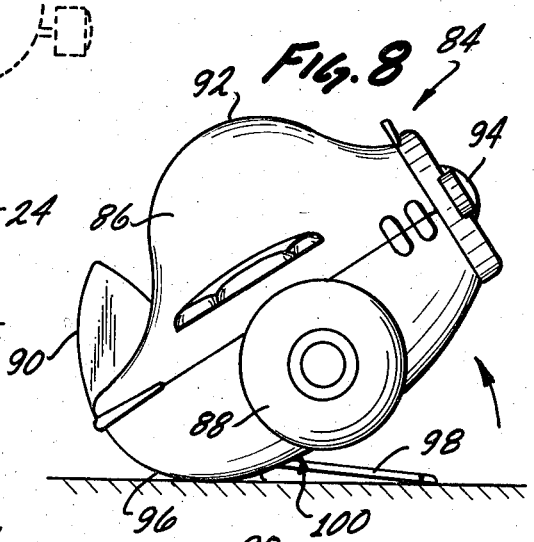
FIGS. 8, 9 and 10 are side elevational views of an alternate embodiment to that shown in FIG. 1 showing how this alternate embodiment performs a sequence of mechanical actions somewhat analogous to the sequence shown in FIGS. 5, 6 and 7.
Figure 9:
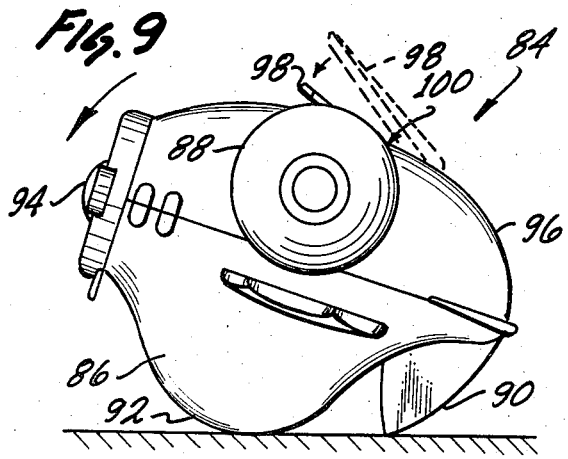
Figure 10:
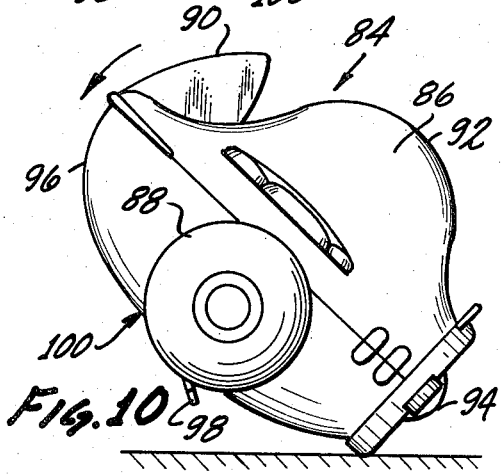

In the alternate embodiment shown in FIGS. 8, 9 and 10 the toy 84 is identical in many respect to the toy 20. The major differences being the shape of the housing 86 and the number of wheels. A similar motor, pivoting member, and drive wheels are utilized. Missing are a second set of wheels corresponding to the front wheels 30 of the toy 20. The knurled knob 46 and shaft 48 are present, however but are hidden from view in FIGS. 8, 9 and 10 since they are on the other side of the toy 84.

The toy 84 is driven along the surface by two wheels 88 which are driven by an appropriate internal motor. The toy 84 is in the general shape of a small airplane. The curved rear surface of the tail 90 in combination with the curved upper surface of the cockpit 92 and the curved propeller hub 94 serve the same function as the curved member 24 and curved surface 40 previously described. The curved surface 96 directly underneath the tail 90 serves as the pivot surface identical in function to pivot surface 42 previously described.

The toy 84 does, however, differ slightly in its manner of rotation from that of the toy 20. When the pivoting member 98 of the toy 84 is extended from bottom surface 100 the toy pivots around pivoting surface 96 and then rolls completely about itself going through a full 360 degree turn. Thus contrary to the toy 20 which only becomes semi-inverted, the toy 84 becomes completely inverted during its roll. Because the toy 84 has one set of wheels, when it is traveling forward the pivot surface 96 is slid along the supporting surface to serve as the third point of a triangular type supporting arrangement. The other two triangular points are the wheels 88.

In both of the embodiments illustrated by the toy 20 and the toy 84 the fulcrum points (not numbered or shown, but in fact corresponding to the center of shaft 51) about which pivoting members 50 and 98 pivot are placed proximal or very closed to the pivoting surfaces 42 and 96.

Because of this a rolling motion is imparted to the toys 20 and 84 when the pivot members 50 and 98 are extended. While for the purpose of this specification pivot members 50 and 98 are described as bell cranks (first class levers) other mechanical components such as an eccentric, a cam, a third class lever and other devices could be used.

I claim:

1. A toy adapted to move from an upright position through at least a semi-inverted position and then back to said upright position at periodic intervals as said toy moves in a forwardly direction along a supporting surface which comprises:

a body having a front, rear, top, bottom and sides, said body being shaped so as to include a pivot surface located adjacent to said bottom of said body and so as to include a curved exterior surface extending generally along at least a part of the top of said body;

wheel means attached to said body for supporting said body in said upright position on said supporting surface;

motor means mounted on said body;

means for transmitting mechanical power from said motor means to said wheel means so as to move said toy in said forward direction when said toy is in said upright position, said means for transmitting mechanical power being connected to said wheel means and to said motor means;

a lever means for pivoting said body from said upright position about said pivot surface until such time as the weight of said body causes said body to roll on said curved surface, said lever means being pivotally mounted on said body and being capable of being pivoted along the longitudinal axis of said body between a retracted position in which said lever means is located generally adjacent to said bottom of said body and an extended position in which said lever means extends outwardly from said bottom of said body;

means for periodically pivoting said lever means from said retracted to said extended position and then back to said retracted position as said motor means is operated, said means for periodically pivoting said lever means being connected to and driven by said motor means and being connected to said lever means;

said pivot and said curved surfaces and said lever means being proportioned so that as said lever means is moved from said retracted position to said extended position, said body will be moved so that said pivot surface contacts said supporting surface and will be pivoted about said pivot surface until such time as the instability of said body causes said body to roll on said curved surface back to said upright position;

said body and said wheels being proportioned so that said toy will automatically roll on said curved surface back to said upright position after said lever means has been extended from said body so as to pivot such body about said pivot surface;

said means for periodically pivoting said lever means being capable of automatically returning said lever means to said retracted position during the time that said toy is rotating about said curved surface;

said motor means comprises a motor having a rotating output shaft;

said means for activating includes a clutch means mounted on said shaft and a linking means operatively connected to said clutch means, said linking means in combination with said clutch means activating said means for levering in response to movement of said shaft;

said clutch means includes a disc member fixedly mounted to said shaft and having at least one ratchet tooth located on said disc member;

said linking means including a sliding member slidably mounted in said body, said sliding member including at least one ratchet engaging means capable of operably interacting with said ratchet tooth such that said sliding member slides when said ratchet tooth engages said ratchet engaging means.

2. A toy adapted to move from an upright position through at least a semi-inverted position and then back to said upright position at periodic intervals as said toy moves in a forwardly direction along a supporting surface which comprises:

a body having fixed front, rear, top, bottom and sides, said body being shaped so as to include a pivot surface located adjacent to said bottom of said body and so as to include a curved exterior surface extending generally along at least a part of the top of said body;

wheel means attached to said body for supporting said body in said upright position on said supporting surface;

motor means mounted on said body;

means for transmitting mechanical power from said motor means to said wheel means so as to move said toy in said forward direction when said toy is in said upright position, said means for transmitting mechanical power being connected to said wheel means and to said motor means;

a lever means for pivoting said body from said upright position about said pivot surface until such time as the weight of said body causes said body to roll on said curved surface, said lever means being pivotally mounted on said body and extending longitudinally on the axis of said body passing through said front and rear of said body and being capable of being pivoted between a retracted position in which said lever means is located generally adjacent to said bottom of said body and an extended position in which said lever means extends outwardly from said bottom of said body;

means for periodically pivoting said lever means from said retracted to said extended position and then back to said retracted position as said motor means is operated, said means for periodically pivoting said lever means being connected to and driven by said motor means and being connected to said lever means;

said pivot and said curved surfaces and said lever means being proportioned so that as said lever means is moved from said retracted position to said extended position, said body will be moved initially in a plane which includes said longitudinal axis so that said pivot surface contacts said supporting surface and will be pivoted about said pivot surface until such time as the instability of said body causes said body to roll on said curved surface back to said upright position;

said body and said wheels being proportioned so that said toy will automatically roll on said curved surface back to said upright position after said lever means has been extended from said body so as to pivot such body about said pivot surface;

said means for periodically pivoting said lever means being capable of automatically returning said lever means to said retracted position during the time that said toy is rotating about said curved surface.

3. The toy of claim 2 wherein:

said curved surface extends around at least that portion of said body which is on the opposite side of said body from said bottom.

4. The toy of claim 2 wherein:

said curved surface terminates proximal to said bottom.

5. The toy of claim 2 wherein:

said motor means comprises a motor having a rotating output shaft;

said means for activating includes a clutch means mounted on said shaft and a linking means operatively connected to said clutch means, said linking means in combination with said clutch means activating said means for levering in response to movement of said shaft.

6. The toy of claim 5 wherein:

said curved surface extends around at least that portion of said body which is on the opposite side of said body from said bottom;

said curved surface terminates proximal to said bottom.

7. The toy of claim 2 wherein:

said curved exterior surface is located on a curved member extending outwardly from said top of said body.

8. The toy of claim 2 wherein:

said curved exterior surface forms a part of the top of said body.

9. A toy adapted to move from an upright position through at least a semi-inverted position and back again to the upright position which comprises:

a body;

said body shaped to include at least a lower surface, a pivot surface and a curved surface;

wheel means attached to said body for supporting said body in an upright position on a supporting surface with said lower body surface adjacent to said supporting surface;

said curved surface extending around at least a portion of said body, said body being adapted to roll on said curved surface and coming to rest in said upright position;

means for levering said body from said upright position mounted on said body, said levering means being adapted to be moved towards said supporting surface when said body is in said upright position so as to contact said supporting surface to tilt said body and lower said pivot surface into contact with said supporting surface;

motor means mounted in said body, said motor means having a drive shaft;

said means for levering comprising a lever pivotally mounted on said body adjacent to one of its ends so as to be capable of movement between a retracted position in which said lever is located generally adjacent to said bottom of said body and an extended position in which said lever extends outwardly from said bottom of said body;

means for activating said levering means connected to and driven by said motor means and connected to said levering means so as to periodically cause movement of said levering means sufficient to result in said body pivoting about said pivot surface on to said curved surface and then rolling on said curved surface back to said upright position;

said means for activating includes a ratchet arm terminating in a ratchet tooth, said ratchet arm being carried by said shaft so as to extend outwardly therefrom, a linking member extending generally between said shaft and said one of said ends of said lever, and spring means extending between said linking member and said body;

said linking member including channel means fitting around said shaft in such a manner as to permit said linking member to be moved transverse to said shaft;

one end of said linking member being pivotally connected to said lever so that movement of said linking member causes pivotal movement of said lever relative to said body;

said spring means serving to bias said linking member toward a position in which the connection of said linking member with said lever causes said lever to be in said retracted position;

a portion of said linking member being capable of being engaged by said ratchet tooth during rotation of said shaft so as to cause movement of said linking member away from said position in which said lever is in said retracted position to a position such that said linking member holds said lever in said extended position;

said ratchet tooth being capable of disengaging said portion of said linking member when said lever is in said extended position so as to permit said spring means to move said linking member so as to cause said lever to move to said retracted position.

* * * * *